US006305264B1

(12) United States Patent
Yang et al.

(10) Patent No.: US 6,305,264 B1
(45) Date of Patent: Oct. 23, 2001

(54) ACTUATOR CONTROL CIRCUIT

(75) Inventors: Qinghai Yang, Ichikawa; Masayuki Hosono, Tokyo, both of (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,987

(22) Filed: Oct. 27, 1999

(30) Foreign Application Priority Data

Nov. 5, 1998 (JP) ..... 10-315162
Nov. 5, 1998 (JP) ..... 10-315203
Sep. 24, 1999 (JP) ..... 11-270518

(51) Int. Cl.[7] ..... F15B 13/04
(52) U.S. Cl. ..... 91/447
(58) Field of Search ..... 91/446, 447

(56) References Cited

U.S. PATENT DOCUMENTS 3,954,046 * 5/1976 Stillhard ..... 91/361

* cited by examiner

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

Disclosed is an actuator control circuit which adopts a meter-in control system to control the displacement speed of a piston of a pneumatic cylinder and which is provided with a first pressure control valve to be in a free flow state when compressed air is supplied to the pneumatic cylinder and a second pressure control valve for retaining discharge pressure of compressed air discharged from the pneumatic cylinder to be a previously set predetermined pressure.

14 Claims, 17 Drawing Sheets

BACKGROUND ART FIG. 5
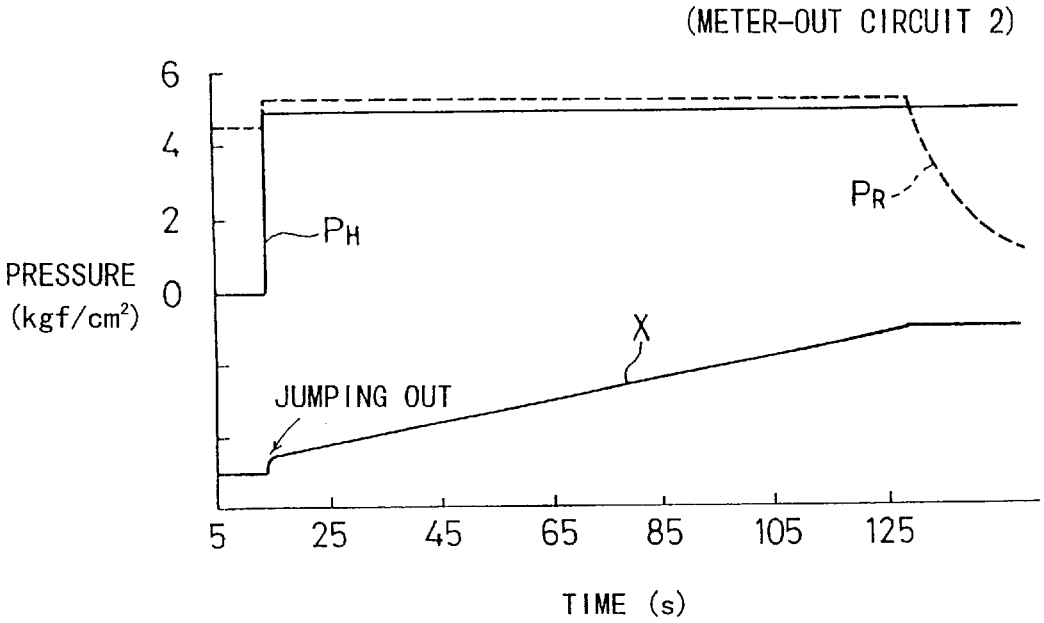
BACKGROUND ART FIG. 6
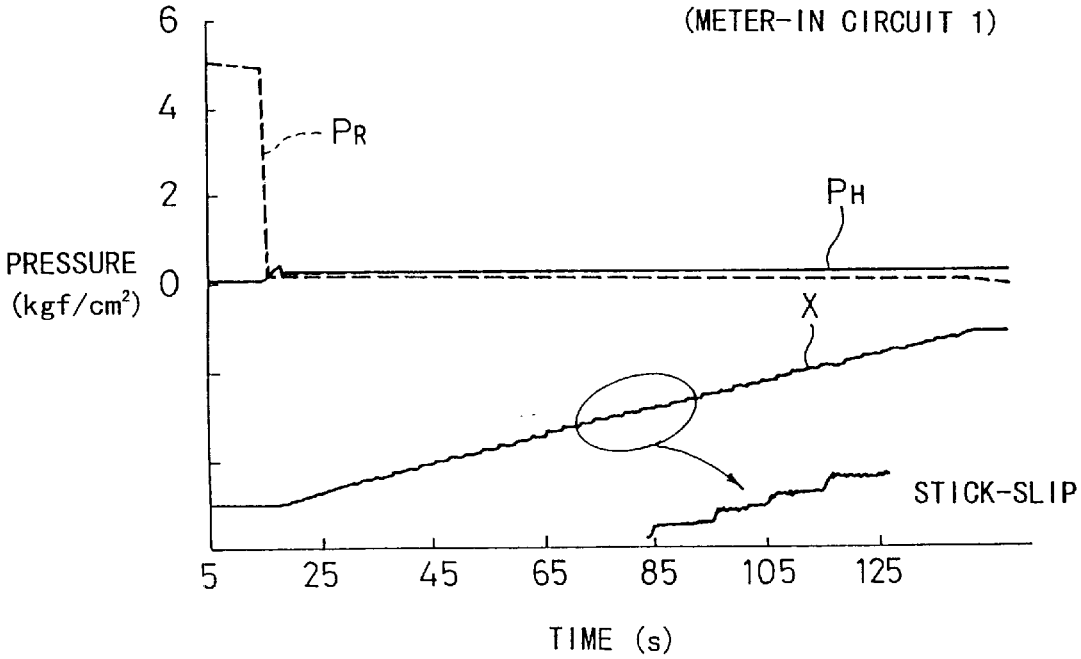

BACKGROUND ART FIG. 19
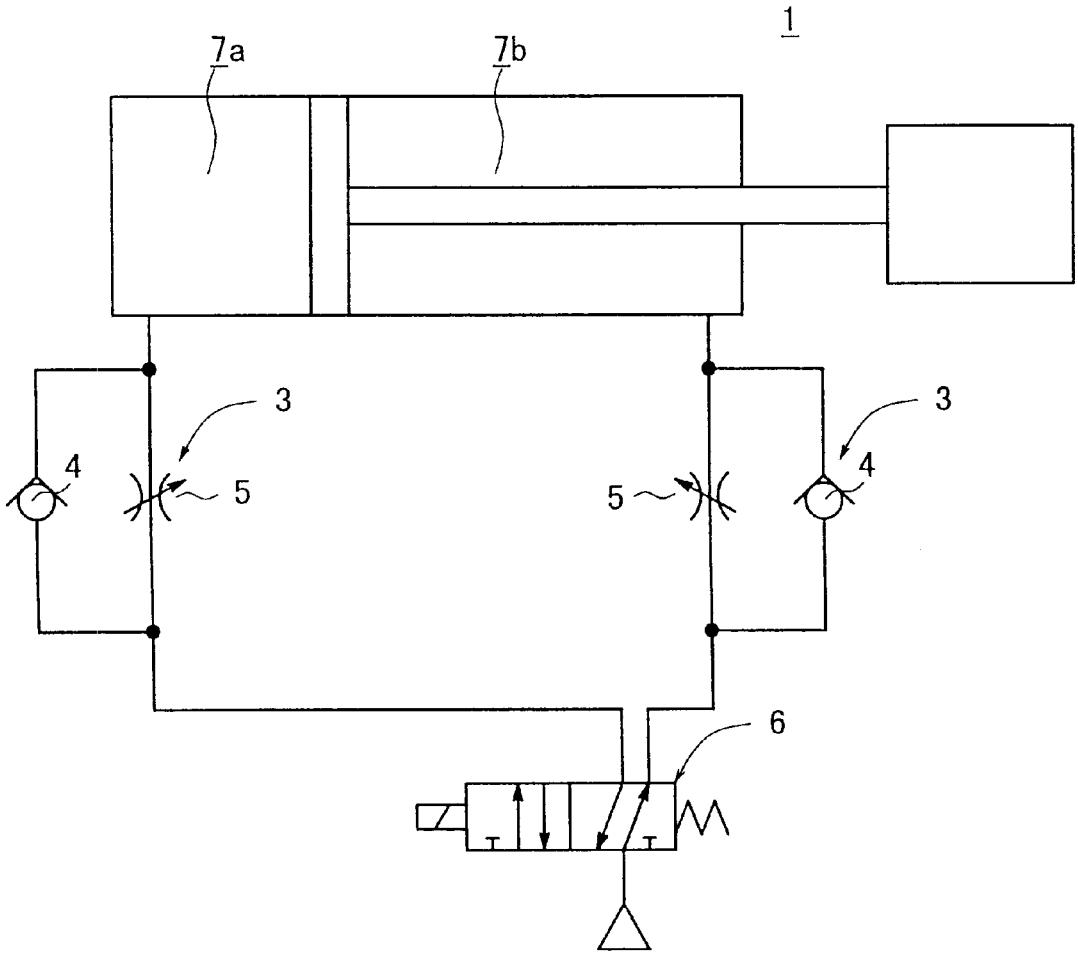

BACKGROUND ART FIG. 20
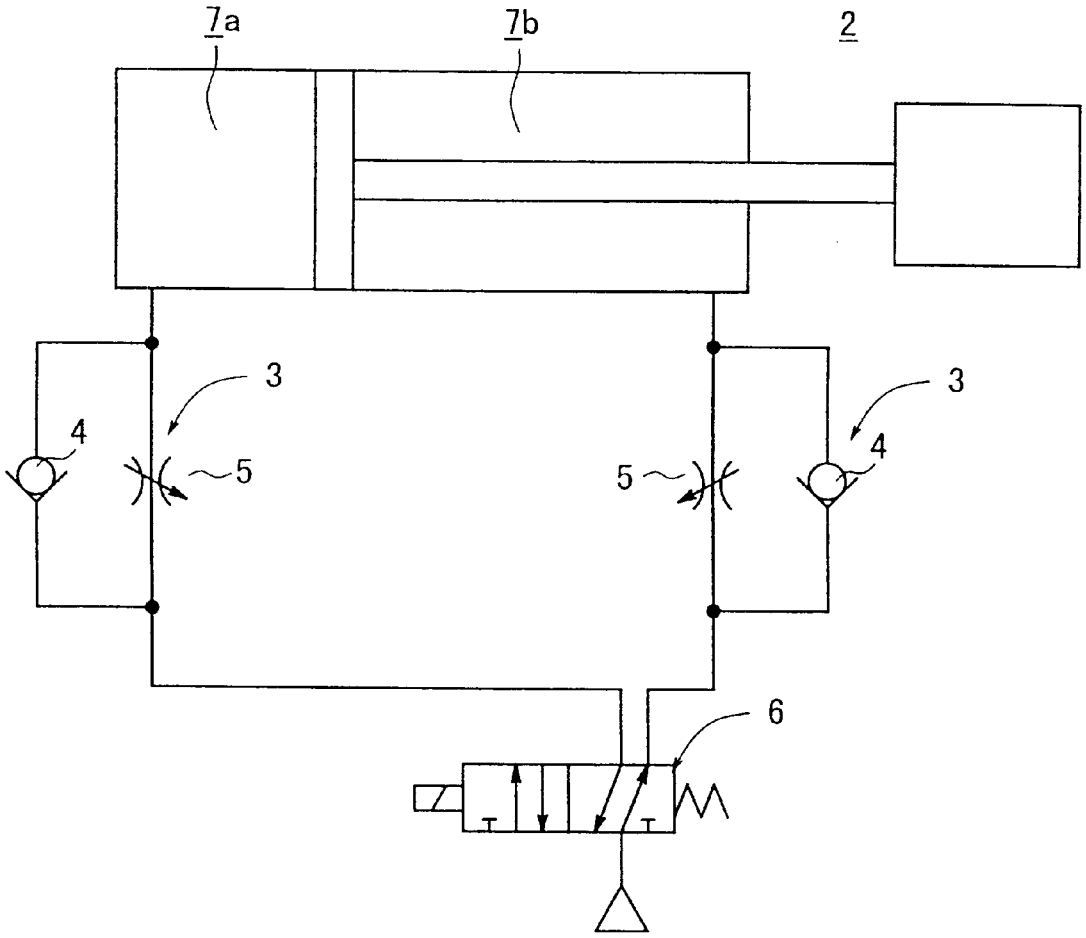

ACTUATOR CONTROL CIRCUIT

BACKGROUND OF THE INVENTION

1. Field of the Invention

The present invention relates to an actuator control circuit which makes it possible to control, for example, the displacement speed of an actuator such as a cylinder.

2. Description of the Related Art

In recent years, an pneumatic actuator, for example, a cylinder is widely used to transport a small object or the like especially in electronic and electric industries as well as in other industries. The cylinder includes a piston which makes rectilinear reciprocating movement along a cylinder chamber of a cylinder tube. Concerning such a cylinder, those generally known to be used when the displacement speed of the piston is controlled include a meter-in circuit 1 (see FIG. 19) which controls the flow rate of the pressure fluid flowing through a passage disposed on the supply side for supplying the pressure fluid into the cylinder chamber, and a meter-out circuit 2 (see FIG. 20) which controls the flow rate of the pressure fluid flowing through a passage disposed on the discharge side for discharging the pressure fluid from the cylinder chamber.

In FIGS. 19 and 20, reference numeral 3 indicates a speed control valve comprising a check valve 4 and a variable throttle valve 5. Reference numeral 6 indicates a switching solenoid-operated valve. Reference numerals 7*a* and 7*b* indicate first and second cylinder chambers respectively.

However, for example, when a pneumatic actuator such as a cylinder is operated at a low speed in order to transport, for example, a small object or the like, if the meter-in circuit 1 is used, then the displacement state and the stop state are intermittently repeated. As a result, an inconvenience occurs in that the so-called stick-slip phenomenon takes place, in which a step-shaped characteristic curve appears, which represents the relationship between the time and the displacement amount.

Further, the meter-in circuit 1 concerning the conventional technique is inconvenient in that the so-called delay of response time occurs, in which the time required to start the displacement of the piston is delayed when the operation of the cylinder is started again after the operation of the cylinder is stopped for a long period of time.

On the other hand, the meter-out circuit 2 is inconvenient in that the so-called jumping out phenomenon occurs, in which the piston makes quick displacement along the cylinder chamber 7*a* (7*b*) due to any adhesion of the piston when the operation of the cylinder is started again after the operation of the cylinder is stopped for a long period of time.

SUMMARY OF THE INVENTION

A general object of the present invention is to provide an actuator control circuit which makes it possible to control the displacement speed of an actuator at a low speed in a stable manner by excluding the occurrence of the stick-slip phenomenon and the jumping out phenomenon.

A principal object of the present invention is to provide an actuator control circuit which makes it possible to improve the delay of response time which appears when the operation of a cylinder is started again after the operation of the cylinder is stopped for a long period of time.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 5 shows a characteristic curve illustrating the relationship between the time and the pressure of the meter-out circuit concerning the conventional technique;

FIG. 6 shows a characteristic curve illustrating the relationship between the time and the pressure of the meter-in circuit concerning the conventional technique;

FIG. 19 shows a circuit arrangement of the meter-in circuit illustrating the method for controlling the actuator concerning the conventional technique; and FIG. 20 shows a circuit arrangement of the meter-out circuit illustrating the method for controlling the actuator concerning the conventional technique.

DESCRIPTION OF THE PREFERRED EMBODIMENTS

Figure 1:
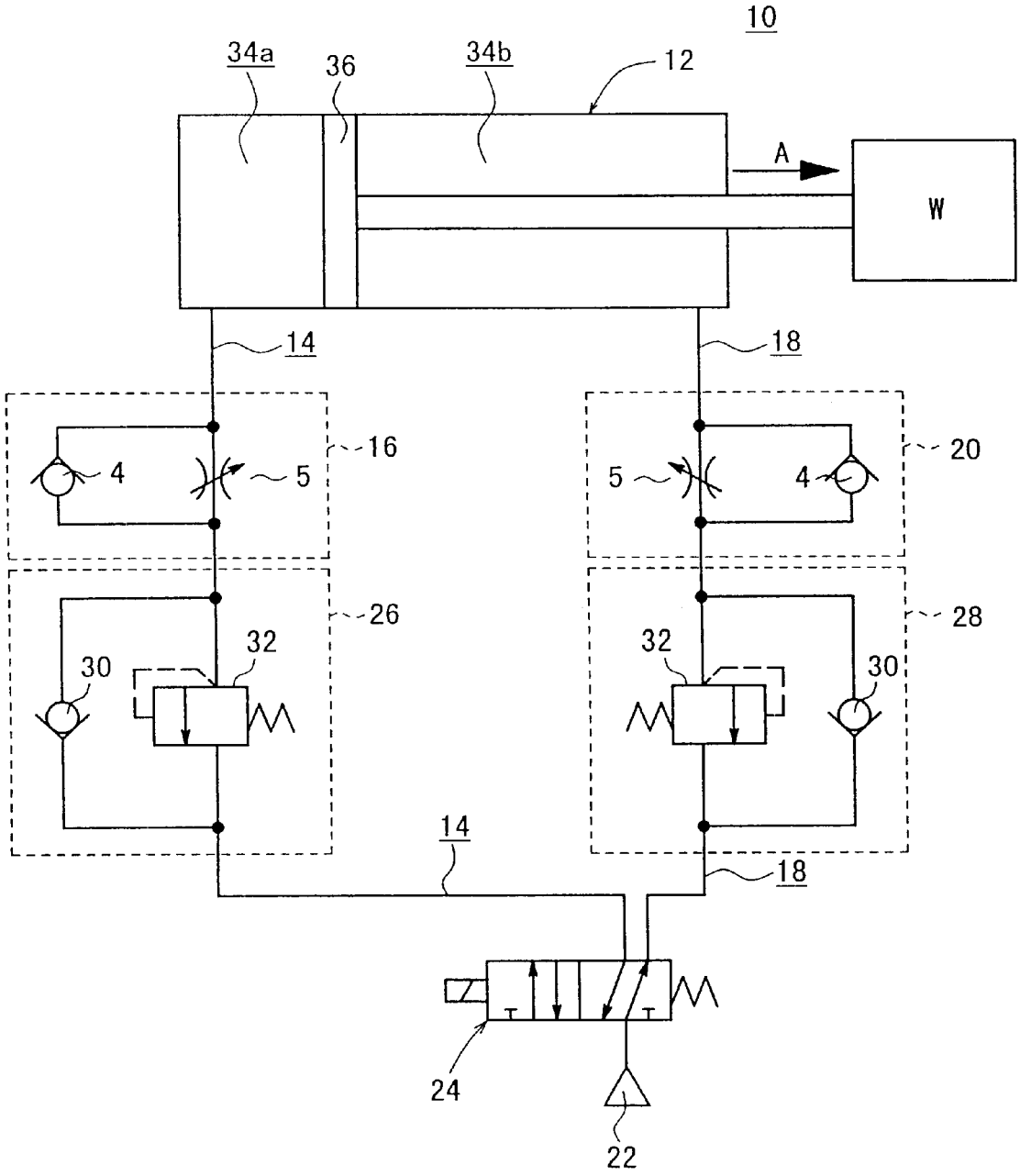
FIG. 1 shows a circuit arrangement of an actuator control circuit according to a first embodiment of the present invention.

FIG. 1 shows an actuator control circuit 10 according to the first embodiment of the present invention.

The actuator control circuit 10 adopts the meter-in control system, and it comprises a pneumatic cylinder (hereinafter simply referred to as "cylinder" as well) 12 for transporting a workpiece W such as a small object, a first speed control valve 16 which is provided on the side of s supply passage (first passage) 14 for the cylinder 12, a second speed control valve 20 which is provided on the side of a discharge passage (second passage) 18 for the cylinder 12, and a switching solenoid-operated valve (switching mechanism) 24 for supplying a pressure fluid (compressed air) from a pressure fluid supply source 22 while making changeover between the first speed control valve 16 and the second speed control valve 20.

The first speed control valve 16 and the second speed control valve 20 are composed of identical constitutive components respectively, and each of them comprises a check valve 4 and a variable throttle valve 5.

The actuator control circuit 10 further comprises a first pressure control valve 26 which is inserted into a portion of the supply passage 14 between the first speed control valve 16 and the switching solenoid-operated valve 24, and a second pressure control valve 28 which is inserted into a portion of the discharge passage 18 between the second speed control valve 20 and the switching solenoid-operated valve 24. In this embodiment, the first speed control valve 16 and the first pressure control valve 26 are connected in series. Similarly, the second speed control valve 20 and the second pressure control valve 28 are connected in series. The first pressure control valve 26 and the second pressure control valve 28 function as a minimum pressure-retaining mechanism.

The first pressure control valve 26 and the second pressure control valve 28 are composed of identical constitutive components respectively, and each of them comprises a check valve 30 and a relief valve 32. The first pressure control valve 26 is in the free flow state when the pressure fluid is supplied to a first cylinder chamber 34*a*. The second pressure control valve 28 functions to retain the discharge pressure so that the discharge pressure is not decreased to be lower than a preset pressure when the pressure fluid is discharged from a second cylinder chamber 34*b*.

The arrangement of the first pressure control valve 26 (second pressure control valve 28) will now be explained in detail below.

Figure 2:
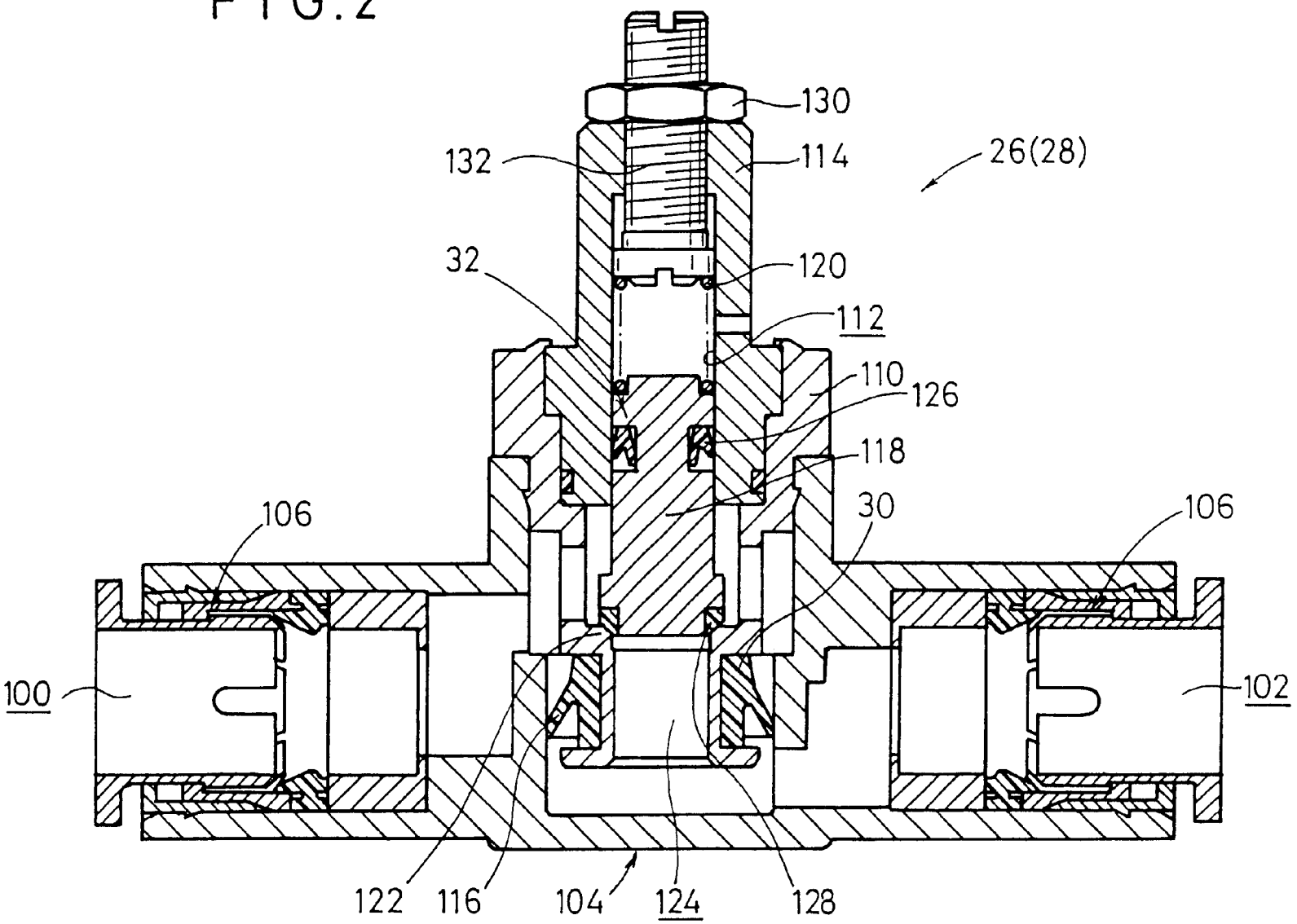
FIG. 2 shows a longitudinal sectional view illustrating an arrangement of a pressure control valve which constitutes the actuator control circuit shown in FIG. 1.

As shown in FIG. 2, the first pressure control valve 26 comprises a valve body 104 which is formed to have a substantially cylindrical configuration and which includes a first port 100 provided at a first end to be connected via an unillustrated tube to the switching solenoid-operated valve 24, and a second port 102 provided at a second end to be connected via the first speed control valve 16 to the cylinder 12. Each of the first port 100 and the second port 102 is provided with a tube joint mechanism 106 for making connection to an unillustrated tube.

A first cylindrical member 110, which extends in a direction substantially perpendicular to the axis of the valve body 104 and which is installed with the check valve 30 disposed on its annular recess at its first end, is provided at a substantially central portion of the valve body 104. A second cylindrical member 114, which has a through-hole 112, is joined to a hole formed at a second end of the first cylindrical member 110.

The check valve 30 includes a tongue 116 which is flexibly bent inwardly in accordance with the pressing action of the compressed air supplied from the first port 100. Accordingly, the check valve 30 functions as follows. That is, the compressed air, which is supplied from the first port 100, is allowed to flow in the free flow state to the second port 102. The tongue 116 contacts with the inner wall surface of the valve body 104 in accordance with the pressing action of the compressed air supplied from the second port 102. Thus, the compressed air is prohibited from flowing from the second port 102 to the first port 100.

In other words, the compressed air freely flows in the direction from the first port 100 to the second port 102. However, the compressed air is prohibited from flowing in the direction opposite to the above, i.e., from the second port to the first port 100 in accordance with the checking action effected by the check valve 30.

A displacement member 118, which makes displacement in the direction substantially perpendicular to the axis of the valve body 104, is slidably provided in the through-hole 112 of the second cylindrical member 114. The displacement member 118 is seated on a seat section 122 in accordance with the resilient force of a spring member 120. Accordingly, the communication between the first port 100 and the second port 102 is blocked. In this embodiment, a chamber 124, which makes communication with the second port 102, is formed by the inner wall surface at the first end of the first cylindrical member 110 installed with the check valve 30. When the displacement member 118 is seated on the seat section 122, the chamber 124 is in a state in which the communication with the first port 100 is blocked.

That is, the displacement member 118 is in a state in which it is always urged downwardly to seat on the seat section 122 in accordance with the resilient force of the spring member 120. When the pressure of the compressed air supplied from the second port 102 to the chamber 124 overcomes the resilient force of the spring member 120, the displacement member 118 is separated from the seat section 122. When the resilient force of the spring member 120 is balanced with the pressure of the compressed air, the predetermined preset pressure is retained. The displacement member 118 is installed with a seal ring 126 by the aid of an annular groove, and it is installed with an elastic member 128 disposed at its first end to mitigate the shock caused when the displacement member 118 is seated on the seal member 122.

The second cylindrical member 114 is provided with an adjustment screw 132 which is fastened by a lock nut 130. The resilient force of the spring member 120 to press the displacement member 118 downwardly can be adjusted by increasing or decreasing the screwing amount of the adjustment screw 132. Therefore, the pressure of discharge from the cylinder 12 can be set to be a predetermined minimum pressure by increasing or decreasing the screwing amount of the adjustment screw 132 to adjust the resilient force of the spring member 120.

The displacement speed of the piston 36 of the cylinder 12 is adjusted by the first speed control valve 16 and the second speed control valve 20. The lower limit value of the discharge pressure can be set to be high by providing the first pressure control valve 26 and the second pressure control valve 28, as compared with the meter-in circuit 1 concerning the conventional technique shown in FIG. 19.

The actuator control circuit 10 according to the first embodiment is basically constructed as described above. Next, its operation, function, and effect will be explained.

When the switching solenoid-operated valve 24 is switched from the OFF state to the ON state on the basis of a switching signal inputted from an unillustrated controller, then the compressed air, which is discharged from the pressure fluid supply source 22, passes through the first pressure control valve 26 and the first speed control valve 16 communicating with the supply passage 14, and it is introduced into the first cylinder chamber 34*a*.

In this arrangement, the checking action is not effected in the first pressure control valve 26, and hence the free flow state is given. The compressed air, which has passed through the first pressure control valve 26, is throttled to have a predetermined flow rate by the aid of the variable throttle valve 5 of the first speed control valve 16, and then it is introduced into the first cylinder chamber 34*a*. That is, in the first pressure control valve 26, the tongue 116 is flexibly bent inwardly in accordance with the pressing action of the compressed air supplied from the first port 100. Thus, the first pressure control valve 26 functions to allow the compressed air supplied from the first port 100 to flow toward the second port 102 in the free flow state.

Therefore, the piston 36 is displaced in the direction of the arrow A in accordance with the pressing action of the compressed air introduced into the first cylinder chamber 34*a*, and thus the workpiece W is transported. During this process, the compressed air, which remains in the second cylinder chamber 34*b*, is discharged to the atmospheric air via the second speed control valve 20 and the second pressure control valve 28 communicating with the discharge passage 18. In this arrangement, the checking action is not effected in the second speed control valve 20, and hence the free flow state is given. The compressed air, which has passed through the second speed control valve 20, is retained so that the pressure is not decreased to have a value lower than the preset pressure value.

That is, the compressed air, which has passed through the second speed control valve 20 in the free flow state, is introduced into the second port 102 of the second pressure control valve 28. The compressed air, which is introduced into the second port 102, is prohibited from its flowing in accordance with the checking action of the check valve 30, and it is supplied to the chamber 124 communicating with the second port 102. In this arrangement, when the pressure (discharge pressure) of the compressed air supplied from the second port 102 to the chamber 124 overcomes the resilient force of the spring member 120, the displacement member 118 is separated from the seat section 122. When the resilient force of the spring member 120 is balanced with the pressure of the compressed air, the discharge pressure of the cylinder 12 is retained to be the predetermined preset pressure. In other words, the second pressure control valve 28 functions to retain the pressure of the discharged compressed air to be the preset pressure. Therefore, the second pressure control valve 28 can be used to set the lower limit value of the discharge pressure to be high.

When the piston 36 is displaced in a direction opposite to the direction A, the first pressure control valve 26 functions in the same manner as the second pressure control valve 28.

Accordingly, the occurrence of the stick-slip phenomenon and the jumping out phenomenon is excluded, and thus the piston 36 of the cylinder 12 can be stably displaced at a low speed.

Next, the fact will be explained below by using numerical expressions, i.e., the control system based on the meter-in circuit 1 is more effective than the control system based on the meter-out circuit 2, concerning the jumping out phenomenon caused by the adhesion of the piston 36 which occurs when the operation is started.

Figure 3:
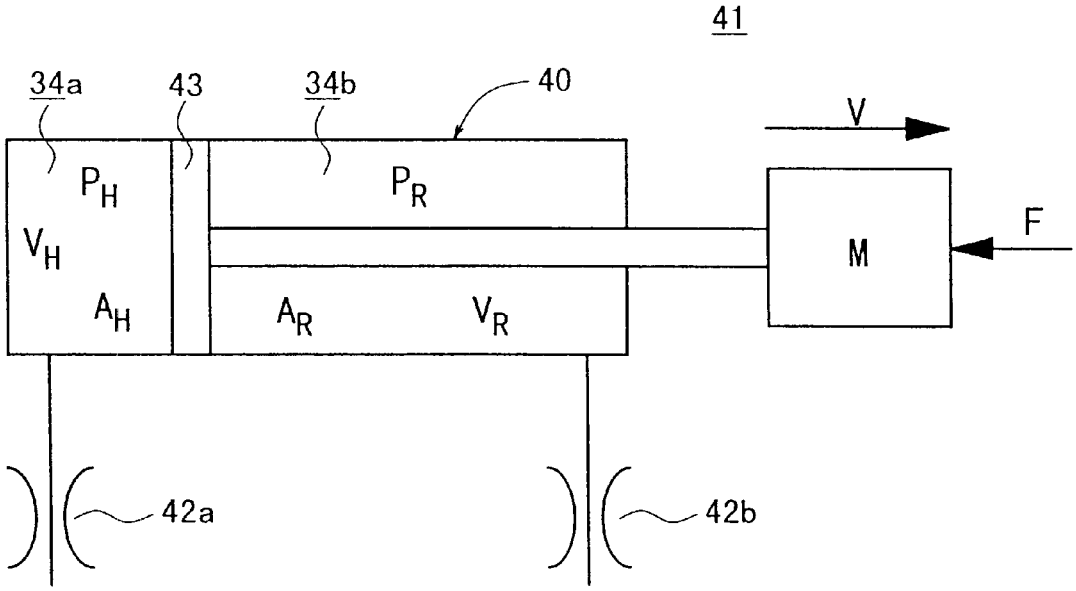
FIG. 3 shows a circuit arrangement used to explain the meter-in control system and the meter-out control system.

Consideration will now be made for a speed control circuit 41 for a pneumatic cylinder 40 shown in FIG. 3.

Reference numerals 42*a* and 42*b* indicate throttles, and reference numeral 43 indicates a piston. Symbols depicted and described in the drawing and the numerical expressions are as follows.

A: pressure-receiving area of piston;

F: external force including static friction force and Coulomb's friction force;

Fs: maximum adhesive force;

M: mass of movable part;

P: pressure in first cylinder chamber 34*a* or second cylinder chamber 34*b;*

R: gas constant;

T: temperature of air (absolute temperature);

v: velocity;

Vc: volume of cylinder 40;

x: displacement amount;

b: viscous friction coefficient;

kp: pressure-flow rate coefficient of speed control valve;

ξ: specific heat ratio of air;

ξ: damping coefficient;

$\omega_n$: natural frequency.

Symbols indicated by subscripts are H to indicate the head side, R to indicate the rod side, and "a" to indicate the atmospheric pressure state respectively.

At first, consideration is made for the jumping out phenomenon due to the adhesion which is caused when the operation is started. The force balance equation represented by the following expression (1) holds concerning the straight line along which the piston 43 jumps out.

$$P_{H0}A_H=P_{R0}A_R+F_S+P_a(A_H-A_R) \tag{1}$$

In the expression (1), "0" represents the initial state immediately before the jumping out. The piston 43 overcomes the maximum adhesive force Fs, and it jumps out to arrive at the state of balance again. If the Coulomb's friction force and the dynamic friction force are neglected, the expression (1) is rewritten into the following expression (2).

$$P_HA_H=P_RA_R+P_a(A_H-A_R) \tag{2}$$

The period of time, which elapses during the jumping out process, is short. Therefore, the inflow and the outflow of the air are neglected concerning the inside of the cylinder chambers 34*a*, 34*b*. Further, it is assumed that the change of state, which occurs in the first cylinder chamber 34*a* and the second cylinder chamber 34*b*, is isothermal. On this assumption, the following expression (3) is obtained according to the equation of state of the gas.

$$\left.\begin{aligned} P_H(V_{H0}+x_JA_H)&=P_{H0}V_{H0}\\ P_R(V_{R0}-x_JA_R)&=P_{R0}V_{R0}\end{aligned}\right\} \tag{3}$$

In the expression (3), the symbol $x_j$ indicates the displacement amount (jumping out distance) of the piston 43 moved from the jumping out of the piston 43 to the arrival at the state of balance again.

If the asymmetricalness is neglected, i.e., if $Pa(A_H-A_R)=0$ holds, the jumping out distance $x_j$ is represented by the following expression (4) according to the expressions (1) to (3) described above.

$$x_J = \frac{1}{\frac{P_{R0}A_R}{F_S}\left(\frac{A_H}{V_{H0}} + \frac{A_R}{V_{R0}}\right) + \frac{A_R}{V_{R0}}} \tag{4}$$

According to the expression (4), the jumping out distance $x_j$ can be made small when the maximum adhesive force Fs is small, when the initial pressure $P_{R0}$ on the discharge side is high, and when the initial volume is small on the head side and the rod side. In this viewpoint, the air supply side is in the free flow state in the case of the meter-out circuit 20 concerning the conventional technique shown in FIG. 20. Therefore, there are given $V_{H0} \approx \infty$ and $V_{R0} \approx Vc$. On the contrary, in the case of the meter-in circuit 1 concerning the conventional technique shown in FIG. 19, the air supply side is throttled, and the discharge side is in the free flow state. Therefore, there are given $V_{H0} \approx 0$ and $V_{R0} \approx \infty$. Accordingly, in view of the prevention of the occurrence of the jumping out phenomenon, it is preferable to use the meter-in circuit 1, and it is desired to increase the initial pressure on the discharge side.

Next, consideration will be made for a method for preventing the occurrence of the stick-slip phenomenon.

Usually, the opening degree of the variable throttle valve 5 is fixed during the displacement of the piston 43.

Therefore, it is considered that the variation of the displacement speed of the piston 43 is caused by the change of the loaded external force which is, for example, the friction force in many cases. In this description, the transfer function is derived between the external force and the velocity of the circuit to investigate the influence of the change of the external force on the displacement speed of the piston 43.

Concerning the cylinder 40 which is attached in the horizontal state, the equation of motion of the piston 43 is given by the following expression (5).

$$M\frac{dv}{dt} + bv = A_H(P_H - P_a) - A_R(P_R - P_a) - F \tag{5}$$

It is assumed that the temperature of the air in the cylinder chambers 34*a*, 34*b* is equal to the temperature of the supply air, and the change of state in the cylinder chambers 34*a*, 34*b* is adiabatic. Further, if the asymmetricalness is neglected, the transfer function between the external force F and the displacement speed v of the piston 43 is represented by the following expression (6).

$$\frac{V(s)}{F(s)} = -\frac{(s+z)/M}{s^2 + 2\xi\omega_n s + \omega_n^2} \tag{6}$$

In the expression (6), "s" indicates the Laplace variable.

$$\left.\begin{aligned} \omega_n &= \sqrt{\frac{\kappa bRTk_p}{MV_c} + \frac{\kappa A_H^2 P_H}{MV_c} + \frac{\kappa A_R^2 P_R}{MV_c}} \\ \xi &= \frac{b}{2M\omega_n} + \frac{\kappa RTk_p}{2V_c\omega_n} \\ z &= \frac{\kappa RTk_p}{V_c} \end{aligned}\right\} \tag{7}$$

The expression (6) represents the relation of the transfer function between the change of the external force and the change of the displacement speed of the piston 43 caused thereby. According to the expression (6), it is desirable that the natural frequency $\omega_n$ is high in order to decrease the change of the displacement speed of the piston 43 caused by the external force. According to the expression (7), it is necessary that the high pressure is maintained in the second cylinder chamber 34*b* disposed on the discharge side, in order to increase the natural frequency $\omega_n$ for the cylinder 40 which has a constant specification size.

According to the results of the analysis described above, it is preferable to use the meter-in control in order to prohibit the jumping out phenomenon, and it is desired to increase the initial pressure on the discharge side. Further, the following fact has been revealed. That is, it is effective to maintain the high pressure in the cylinder chambers 34*a*, 34*b* in order to prohibit the occurrence of the stick-slip phenomenon.

The actuator control circuit 10 according to the first embodiment of the present invention is the circuit which is constructed on the basis of the consideration as described above. When the actuator control circuit 10 is used, it is possible to prohibit the occurrence of the stick-slip phenomenon and the jumping out phenomenon caused by the adhesion of the piston 36 when the operation is started.

Figure 4:
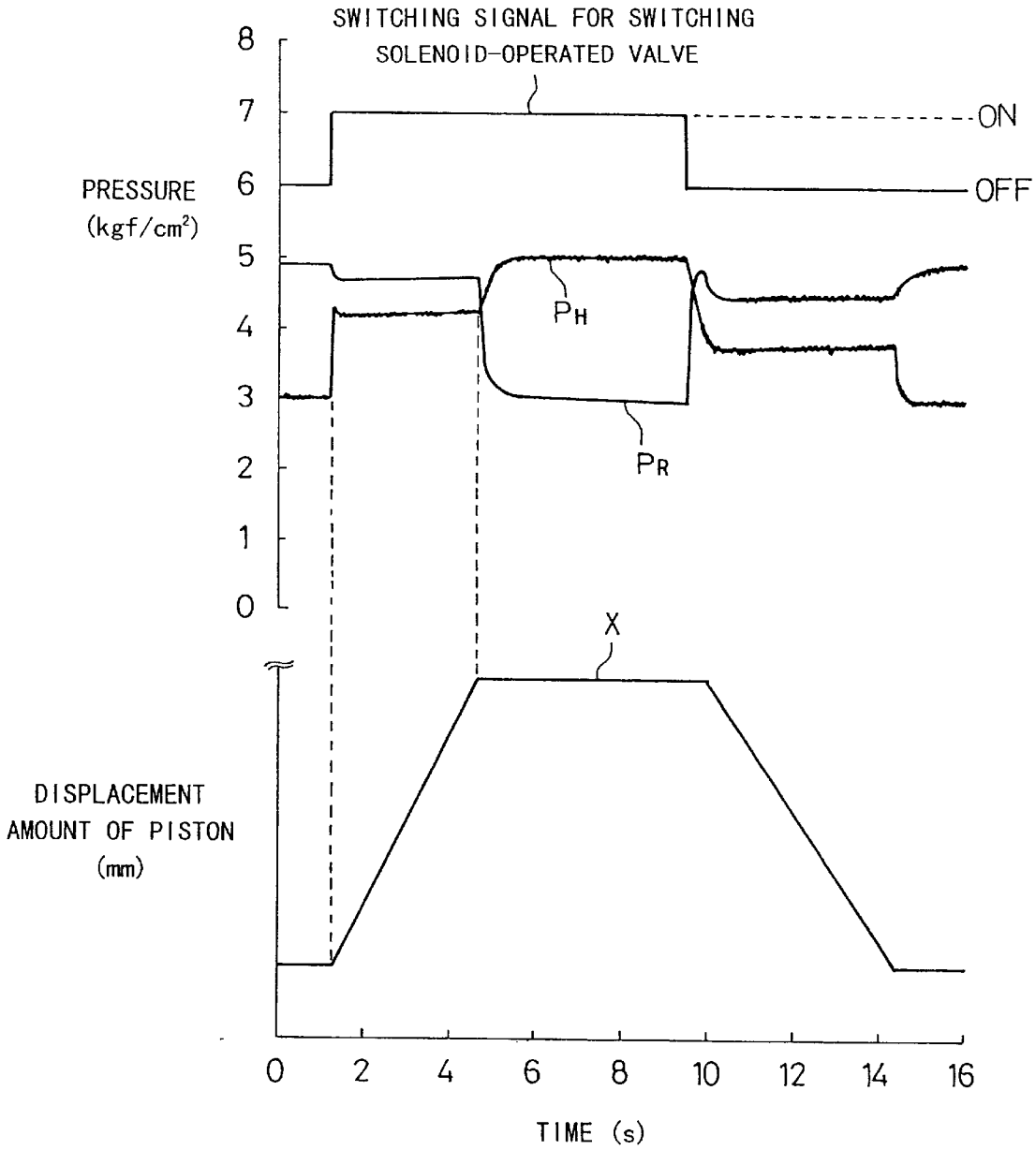
FIG. 4 shows characteristic curves illustrating the relationship of the time and the displacement amount of the piston and the pressure of the actuator control circuit.

Next, FIG. 4 shows response characteristic curves obtained when the actuator control circuit 10 according to the first embodiment is used. In this embodiment, the experiment was performed by setting the supply pressure (gauge pressure) to be 0.5 Mpa, the preset pressure (gauge pressure) of the pressure control valve 26, 28 to be 0.3 Mpa, and the control speed to be 65 mm/s respectively.

As clearly understood from FIG. 4, the operation is performed at a substantially uniform displacement speed while maintaining the preset pressures of the pressure $P_H$ of the cylinder chamber 34*a* disposed on the head side and the pressure $P_R$ of the cylinder chamber 34*b* disposed on the rod side respectively.

Next, the experiment was performed by using the actuator control circuit 10 according to the first embodiment, and the meter-in circuit 1 (see FIG. 19) and the meter-out circuit 2 (see FIG. 20) concerning Comparative Examples.

Figure 7:
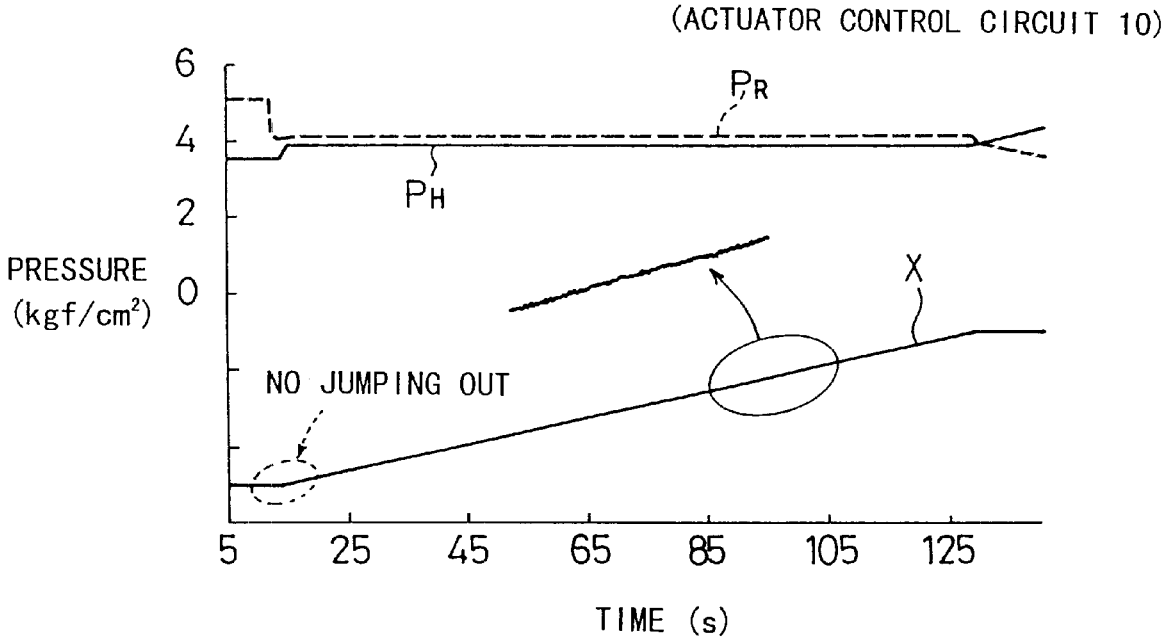
FIG. 7 shows a characteristic curve illustrating the relationship between the time and the pressure of the actuator control circuit.

FIGS. 5 to 7 show response characteristic curves obtained when the operation was continuously performed with the displacement speed of about 1.7 mm/s of the piston 36 of the pneumatic cylinder 12 respectively. As shown in FIG. 5, in the case of the meter-out circuit 2 concerning Comparative Example, the so-called jumping out phenomenon occurs, in which the displacement amount x is quickly increased when the operation of the piston 36 is started. As shown in FIG. 6, in the case of the meter-in circuit 1 concerning Comparative Example, the stick-slip phenomenon occurs, in which the stop state and the displacement state are intermittently repeated to give a step-shaped form during the displacement of the piston 36.

On the contrary, as shown in FIG. 7, in the case of the actuator control circuit 10 according to the first embodiment, neither jumping out phenomenon nor stick-slip phenomenon occurs, in which the piston 36 was successfully displaced in a stable manner at a low speed.

Figure 8:
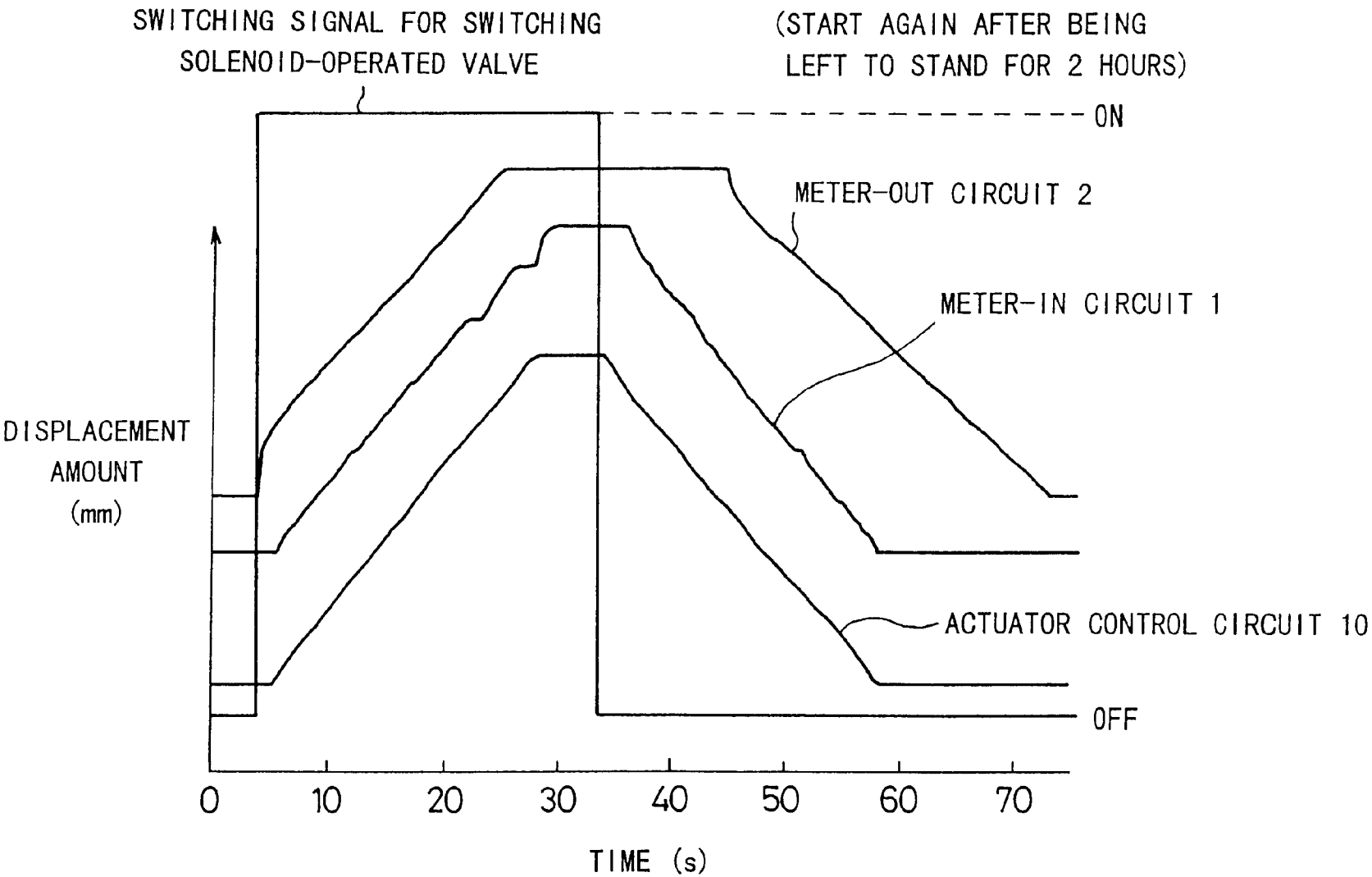
FIG. 8 shows response curves obtained in the first cycle when the actuators are operated again after they are left to stand for 2 hours.
Figure 9:
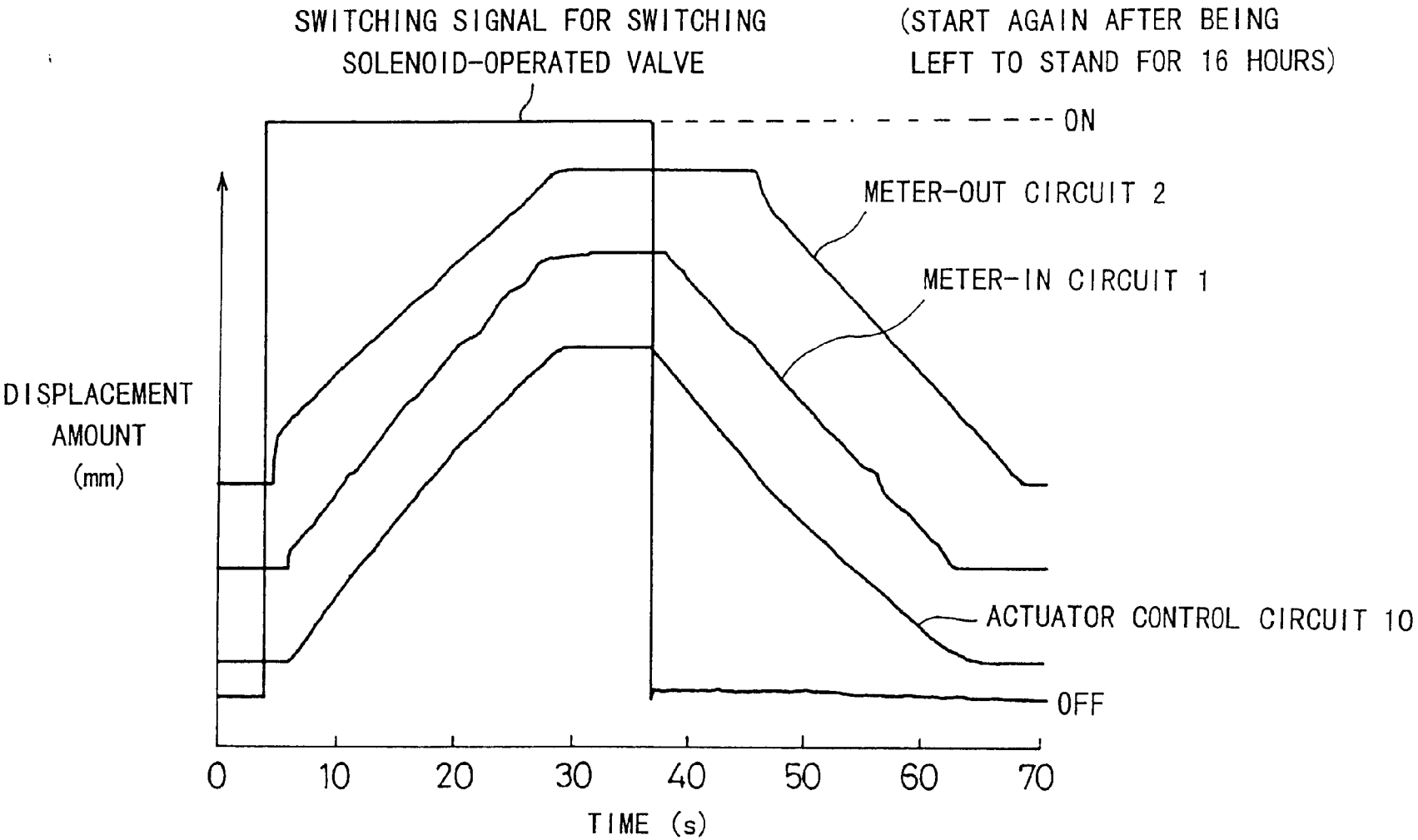
FIG. 9 shows response curves obtained in the first cycle when the actuators are operated again after they are left to stand for 16 hours.

FIGS. 8 and 9 show response curves of the first cycle obtained when the unillustrated actuators operated at a velocity of 1.3 mm/s were left to stand for 2 hours and 16 hours respectively, and then they were started again. As shown in FIGS. 8 and 9, the following fact is understood. That is, in the case of the meter-out circuit 2 and the meter-in circuit 1 concerning Comparative Examples, the conspicuous jumping out phenomenon occurs in the response after being left to stand. On the contrary, in the case of the actuator control circuit 10 according to the first embodiment, such a jumping out phenomenon does not occur.

Judging from the experimental results described above, it has been revealed that the actuator control circuit 10 according to the first embodiment is effective to prevent the occurrence of the jumping out phenomenon and the stick-slip phenomenon which have occurred in the case of the conventional circuit.

Figure 10:
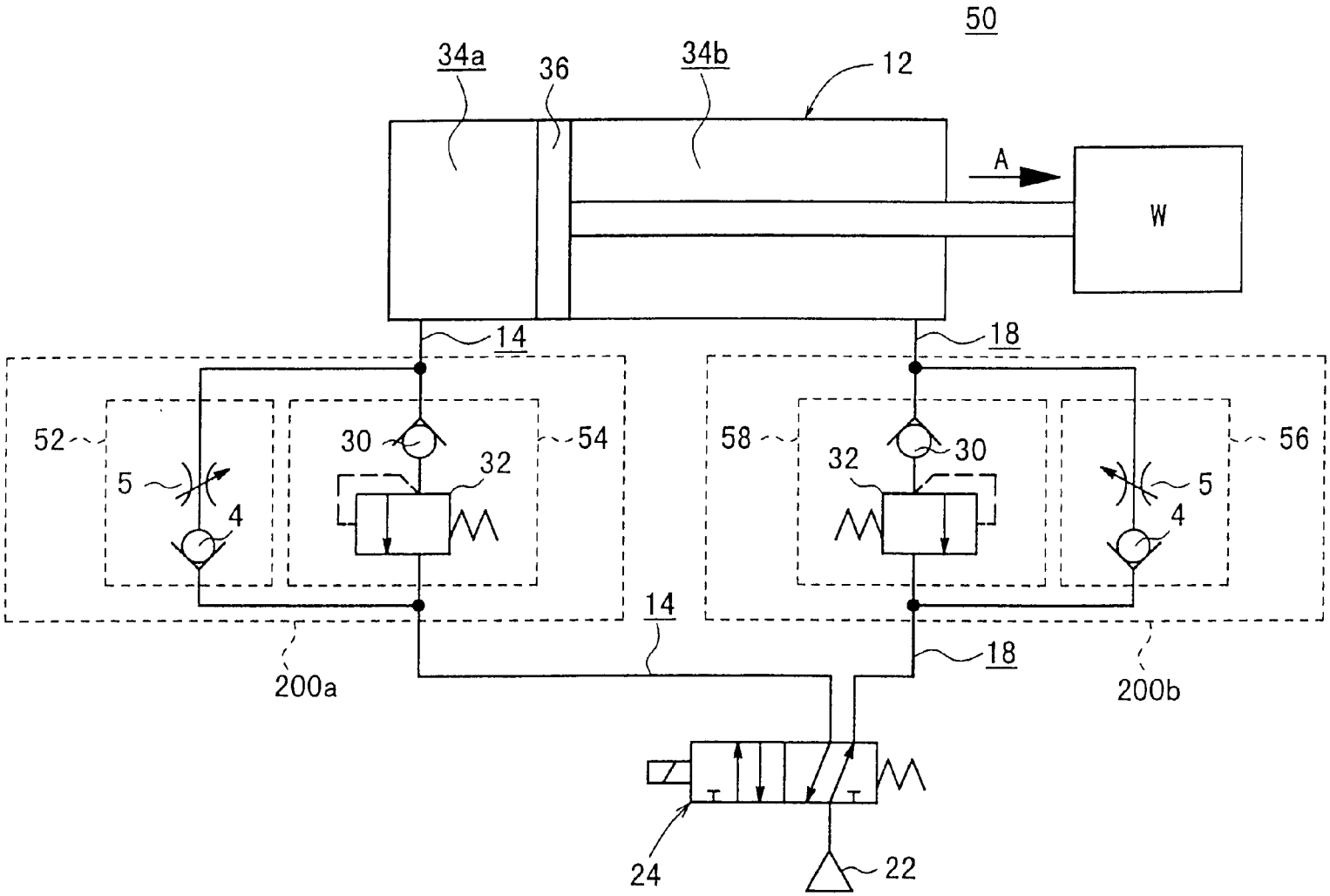
FIG. 10 shows a circuit arrangement of an actuator control circuit according to a second embodiment of the present invention.

Next, an actuator control circuit 50 according to the second embodiment of the present invention is shown in FIG. 10. In the embodiments described below, the same constitutive components as those of the actuator control circuit 10 according to the first embodiment shown in FIG. 1 are designated by the same reference numerals, detailed explanation of which will be omitted.

The arrangement of the actuator control circuit 50 according to the second embodiment is different from that of the first embodiment in that the former comprises a control valve 200*a* including a first speed control valve 52 and a first pressure control valve 54 which are provided integrally in parallel to one another on the side of a supply passage 14 between a cylinder 12 and a switching solenoid-operated valve 24, and a control valve 200*b* including a second speed control valve 56 and a second pressure control valve 58 which are provided integrally in parallel to one another on the side of a discharge passage 18. The control valve 200*a* and the control valve 200*b* are composed of identical constitutive components.

In this embodiment, a check valve 4 and a variable throttle valve 5, which constitute the first speed control valve 52 and the second speed control valve 56, are constructed by being connected in series respectively. Further, a check valve 30 and a relief valve 32, which constitute the first pressure control valve 54 and the second pressure control valve 58, are constructed by being connected in series respectively.

The arrangement of the control valve 200*a* (200*b*)will now be explained in detail below. The same constitutive components as those of the pressure control valve 26 (28) shown in FIG. 2 are designated by the same reference numerals, detailed explanation of which will be omitted.

Figure 11:
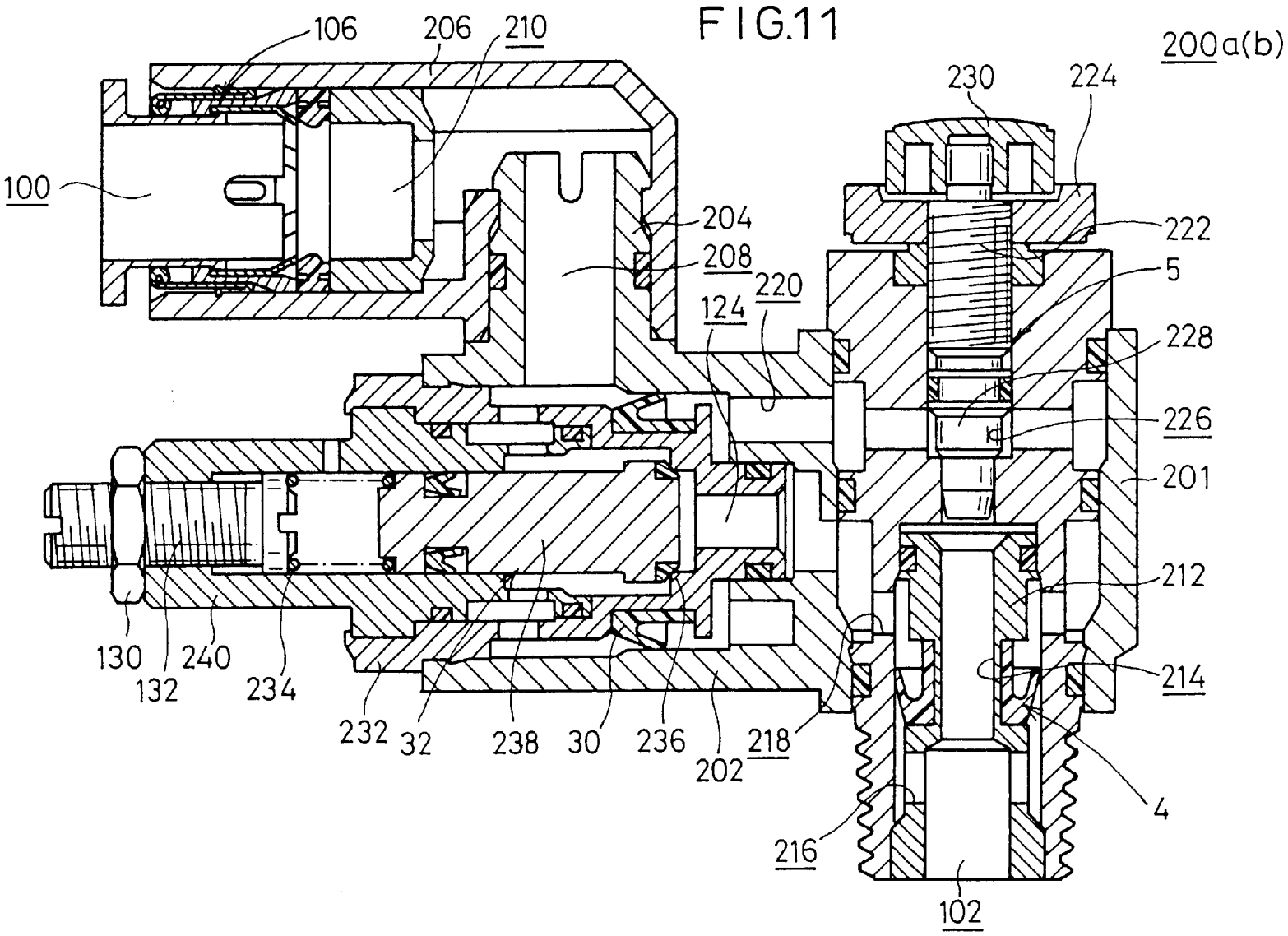
FIG. 11 shows a longitudinal sectional view illustrating an arrangement of a control valve which constitutes the actuator control circuit shown in FIG. 10.

As shown in FIG. 11, the control valve 200*a* (200*b*) comprises a cylindrical first valve body 201 which includes the variable throttle valve 5 and the check valve (first check valve) 4 arranged at the inside thereof, a second valve body 202 which is provided rotatably in a predetermined direction about the center of rotation of the axis of the first valve body 202 and which includes the check valve 30 and the relief valve 32 arranged at the inside thereof, and a third valve body 206 which is provided rotatably in a predetermined direction about the center of rotation of the axis of a projection 204 of the second valve body 202.

A first port 100, which is connected to the switching solenoid-operated valve 24 via an unillustrated tube, is provided at a first end of the third valve body 206. A tube joint mechanism 106 for fastening the tube is arranged at the first port 100. A passage 210, which communicates with a passage 208 provided through the projection 204 of the second valve body 202, is formed at the inside of the third valve body 206.

A second port 102, which communicates with a cylinder chamber (34*a*, 34*b*) of the cylinder 12, is formed at a first end of the first valve body 201. The second port 102 is provided to make communication with a through-hole 214 of a cylindrical member 212 which is fitted and inserted into the inside of the first valve body 201. The check valve 4 is installed to a substantially central portion of the cylindrical member 212. The check valve 4 functions such that the flow of the compressed air from the first port 100 to the second port 102 is prohibited, and the compressed air from the second port 102 to the first port 100 is in the free flow state. The cylindrical member 212 is formed with a hole 216 which allows the compressed air introduced from the second port 102 to flow toward the check valve 4. The first valve body 201 is formed with a hole 218 which allows the compressed air passed through the check valve 4 to flow toward the second valve body 202.

The variable throttle valve 5, which throttles the flow rate of the compressed air supplied from the first port 100, is provided at an upper portion of the first valve body 201. The variable throttle valve 5 includes a throttling screw 222 which faces a passage 220 communicating with the passage 208 of the projection 204 of the second valve body 202, and a lock nut 224 for fixing the throttling screw 222 at a predetermined position. An inserting section 228, which is inserted into a hole 226 of communication between the passage 220 and the through-hole 214, is provided at a first end of the throttling screw 222. The flow rate of the compressed air is throttled to give a predetermined amount by the aid of a clearance which is formed between the hole 226 and the inserting section 228. A knob 230 is provided at a second end of the throttling screw 222. Therefore, when the knob 230 is gripped to rotate the throttling screw 222 in a predetermined direction so that its screwing amount is adjusted, the amount of clearance can be adjusted.

The second valve body 202 is provided with the check valve (second check valve) 30 which is installed to the outer circumferential surface of the first cylindrical member 232, and the relief valve 32 which has a second cylindrical member 240 arranged with a displacement member 238 to be seated on a seat section 236 in accordance with the resilient force of a spring member 234.

The control valve 200*a* (200*b*)is basically constructed as described above. Next, its operation, function, and effect will be explained.

The compressed air, which is supplied from the pressure fluid supply source 22 via the switching solenoid-operated valve 24, is introduced into the first port 100 of the control valve 200*a*. The compressed air passes through the check valve 30 via the passage 210 and the passage 208, and then it is throttled to have a predetermined flow rate by the aid of the variable throttle valve 5. The compressed air is supplied from the second port 102 to the first cylinder chamber 34*a* of the cylinder 12. The piston 36 is displaced in the direction of the arrow A in accordance with the action of the compressed air supplied to the first cylinder chamber 34*a*.

The compressed air, which is discharged from the second cylinder chamber 34*b*, is introduced into the second port 102 of the control valve 200*b*. The compressed air flexibly bends the check valve 4 inwardly, and it passes through the check valve 4. The compressed air is introduced into the relief valve 32 via the hole 218 of the first valve body 201. In the relief valve 32, the flow of the compressed air is blocked in accordance with the checking action of the check valve 30. The compressed air is supplied to the chamber 124 communicating with the hole 218. During this process, when the pressure (discharge pressure) of the compressed air supplied to the chamber 124 via the hole 218 overcomes the resilient force of the spring member 234, the displacement member 238 is separated from the seat section 236. When the resilient force of the spring member 234 is balanced with the pressure of the compressed air, the discharge pressure of the cylinder 12 is retained to be the predetermined preset pressure. In other words, the control valve 200*b* functions to retain the pressure of the discharged compressed air to be the preset pressure. Therefore, the lower limit value of the discharge pressure can be set to be high by using the control valve 200*b*.

When the piston 36 is displaced in the direction opposite to the direction of the arrow A, the control valve 200*a* functions in the same manner as the control valve 200*b*.

The actuator control circuit 50 according to the second embodiment is provided with the control valve 200*a* (200*b*) which includes, in the integrated manner, the check valve 4, the variable throttle valve 5, the check valve 30, and the relief valve 32. Thus, the entire apparatus can be made compact to reduce the installation space. The other functions and effects are the same as those of the first embodiment, detailed explanation of which will be omitted.

Figure 12:
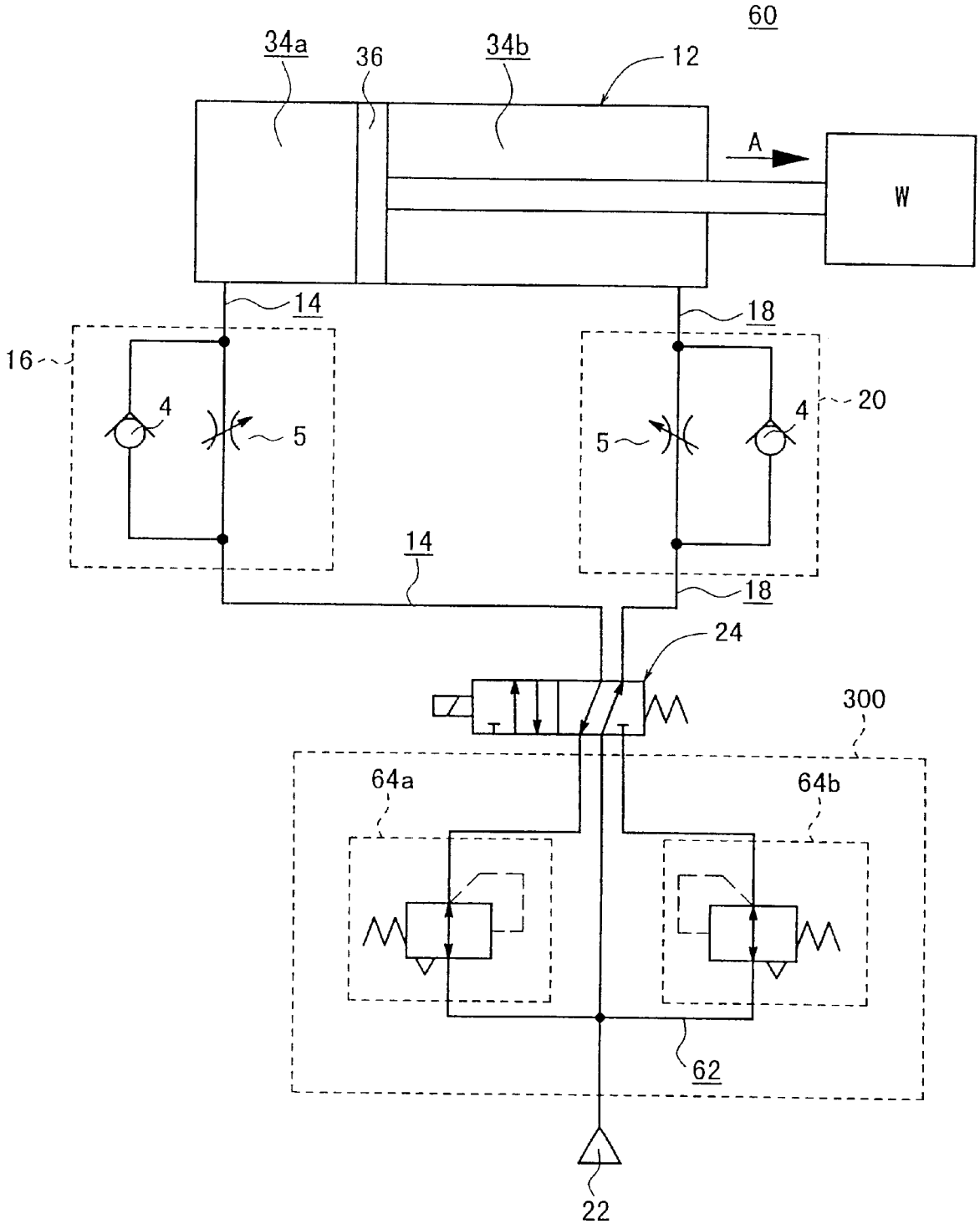
FIG. 12 shows a circuit arrangement of an actuator control circuit according to a third embodiment of the present invention.

Next, FIG. 12 shows an actuator control circuit 60 according to the third embodiment of the present invention.

The actuator control circuit 60 according to the third embodiment comprises a first speed control valve 16 and a second speed control valve 20 which are connected in parallel at portions between a cylinder 12 and a switching solenoid-operated valve 24 respectively, and a first relief-equipped pressure reducing valve 64*a* and a second relief-equipped pressure reducing valve 64*b* (relief mechanism-equipped pressure control valves) which are connected in parallel at portions of a passage 62 between the switching solenoid-operated valve 24 and a pressure fluid supply source 22 respectively.

In this embodiment, each of the first and second relief-equipped pressure reducing valves 64*a*, 64*b* functions as follows. That is, the pressure of the compressed air supplied from the pressure fluid supply source 22 is reduced so that the compressed air is supplied to a cylinder chamber 34*b* (34*a*) of the cylinder 12 disposed on the discharge side. Accordingly, the pressure in the cylinder chamber 34*b* (34*a*) on the discharge side is retained to be a previously set preset pressure. When the pressure in the cylinder chamber 34*b* (34*a*) on the discharge side is higher than the preset pressure, the pressure fluid is discharged to the atmospheric air. Accordingly, the pressure in the cylinder chamber 34*b* (34*a*) on the discharge side is retained to be a previously set predetermined pressure.

Figure 13:
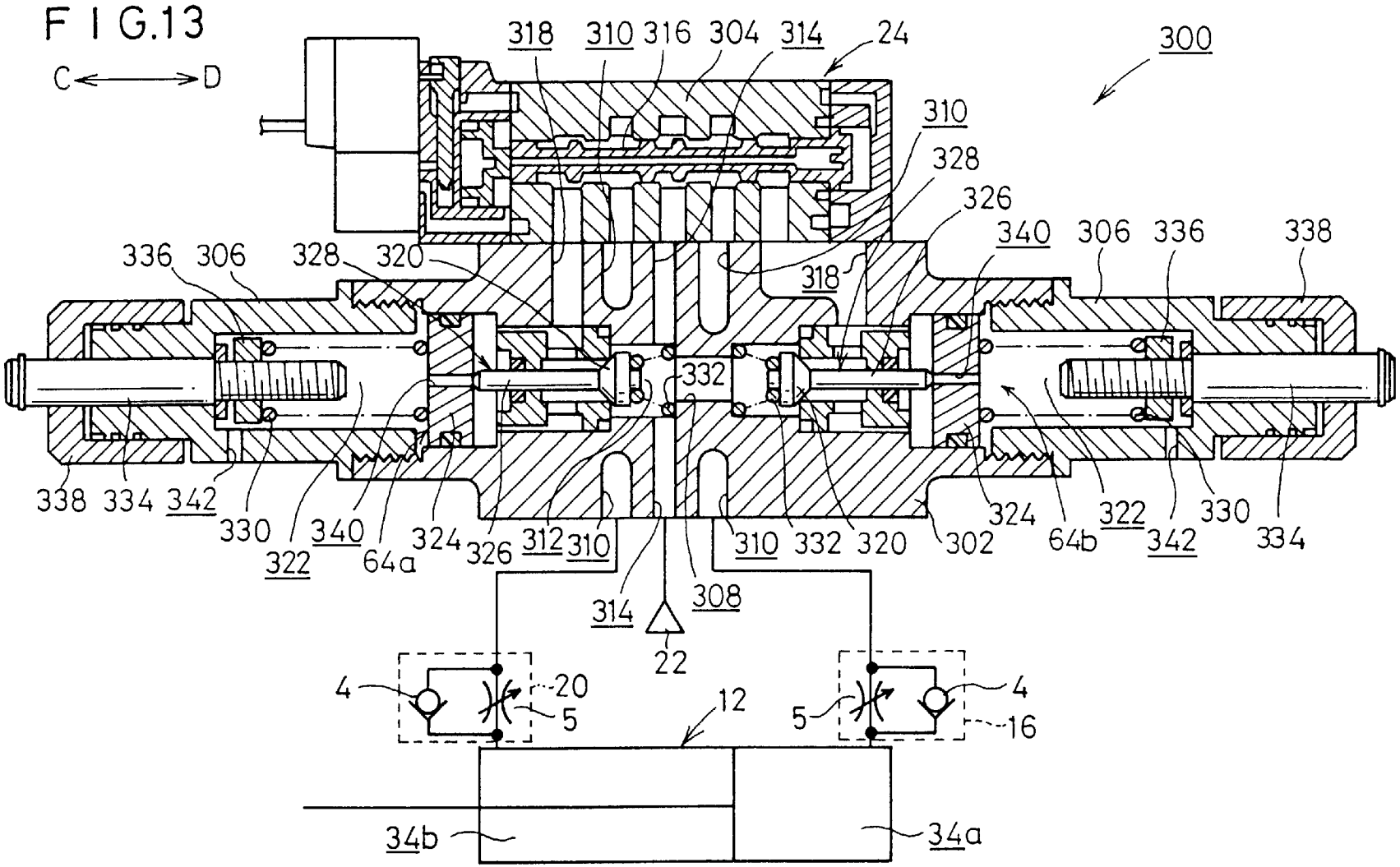
FIG. 13 shows a longitudinal sectional view illustrating an arrangement of a pressure control valve which constitutes the actuator control circuit shown in FIG. 12.
Figure 14:
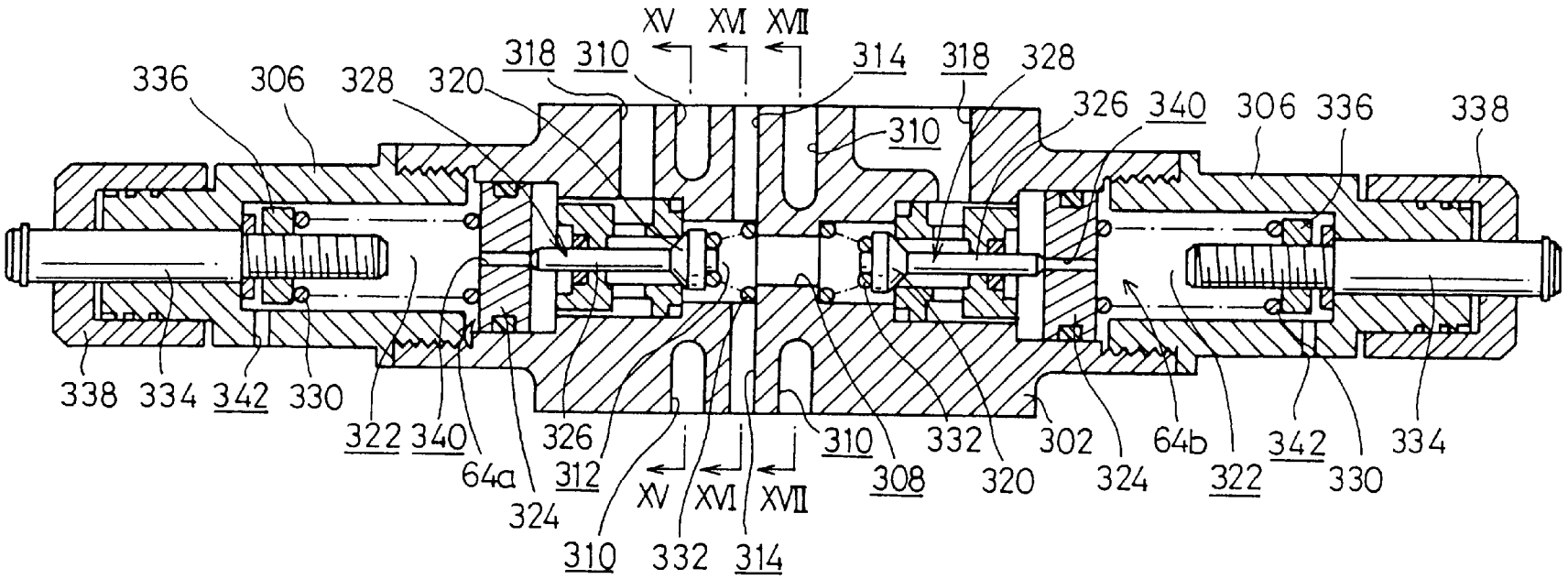
FIG. 14 shows, with partial omission, a longitudinal sectional view illustrating the pressure control valve shown in FIG. 13.

FIG. 13 shows a pressure control valve 300 which is composed of the first relief-equipped pressure reducing valve 64*a*, the second relief-equipped pressure reducing valve 64*b*, and the switching solenoid-operated valve 24 which are joined in an integrated manner.

The pressure control valve 300 comprises a valve body 302 which is formed to have a substantially cylindrical configuration, a solenoid-operated valve body 304 which is integrally joined to a side portion of the valve body 302, and a pair of cap members 306 which are provided to close openings formed at both ends of the valve body 302 respectively.

The first relief-equipped pressure reducing valve 64*a* and the second relief-equipped pressure reducing valve 64*b* are arranged symmetrically at the inside of the valve body 302 respectively. Therefore, only the first relief-equipped pressure reducing valve 64*a* will be explained in detail. Corresponding constitutive components of the second relief-equipped pressure reducing valve 64*b* are designated by the same reference numerals, detailed explanation of which will be omitted.

Figure 17:
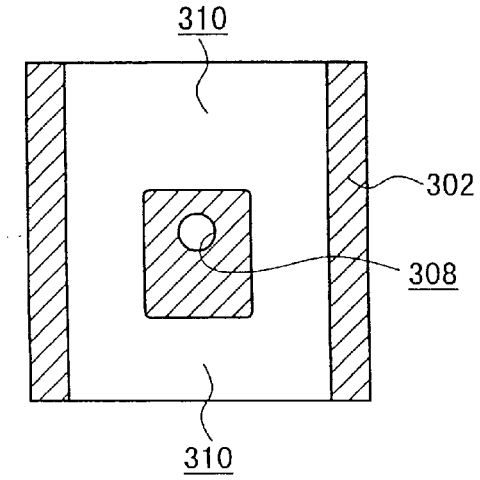
FIG. 17 shows a vertical sectional view taken along a line XVII—XVII shown in FIG. 14.

The first relief-equipped pressure reducing valve 64*a* and the second relief-equipped pressure reducing valve 64*b* are provided to make communication via a communication passage 308 which has a circular cross section and which is formed at a substantially central portion of the valve body 302. The communication passage 308 is provided to make communication with the pressure fluid supply source 22 via a first passage 310 described later on (see FIG. 17).

Figure 15:
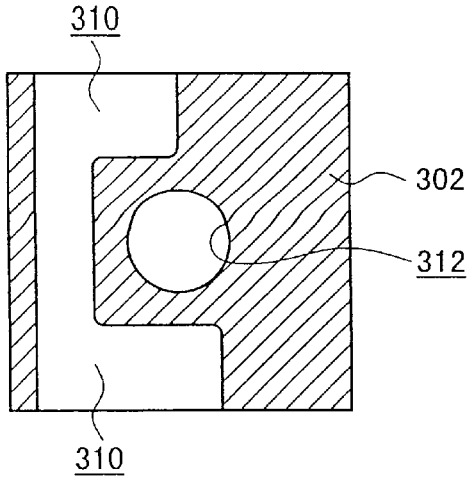
FIG. 15 shows a vertical sectional view taken along a line XV—XV shown in FIG. 14.
Figure 16:
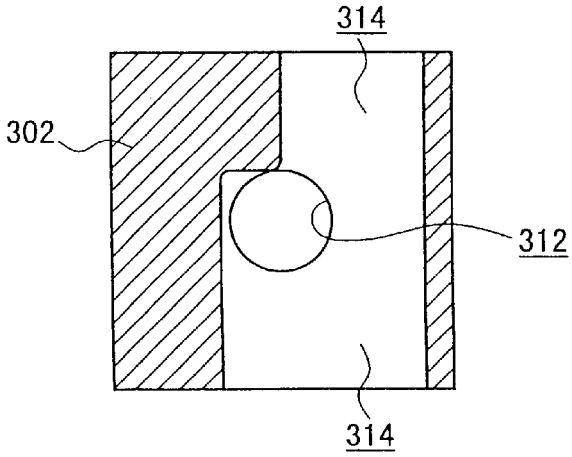
FIG. 16 shows a vertical sectional view taken along a line XVI—XVI shown in FIG. 14.

The valve body 302 includes the first passage 310 (see FIG. 15) for making communication between the speed control valve 20 and the switching solenoid-operated valve 24, a second passage 314 (see FIG. 16) for discharging the pressure fluid supplied from the pressure fluid supply source 22 to the switching solenoid-operated valve 24 via a chamber 312 formed at the inside, and a third passage 318 for introducing the compressed air from the switching solenoid-operated valve 24 into the chamber 312 of the valve body 302 in accordance with the switching action of a spool 316 provided at the inside of the switching solenoid-operated valve 24.

The first relief-equipped pressure reducing valve 64*a* comprises a valve guide 328 which is provided at its first end with a tapered section 320 and at is second end with a pin section 326 for making abutment against a displacement member 324 that makes sliding movement along a chamber 322, a first spring member 330 which is fastened to the displacement member 324 and which presses the valve guide 328 in the direction of the arrow D, and a second spring member 332 which is fastened to the tapered section 320 and which presses the valve guide 328 in the direction of the arrow C. The first spring member 330 is provided such that its resilient force is adjustable by the aid of a receiving member 336 engaged with an adjustment screw 334. Therefore, the valve guide 328 is displaceable substantially in the horizontal direction in accordance with the pressure-adjusting action of the first spring member 330 and the second spring member 332.

The adjustment screw 334 is secured to a nut member 338 for making rotation in a predetermined direction about the center of rotation of the adjustment screw 334. The screwing amount can be increased or decreased by rotating the nut member 338 to integrally rotate the adjustment screw 334.

The tapered section 320 of the valve guide 328 is seated on the seat section. The pin member 326 is provided to close a through-hole 340 which is formed through the displacement member 324. Therefore, when the pressure (discharge pressure) of the compressed air introduced from the third passage 318 overcomes the resilient force of the first spring member 330, the pin member 326 of the valve guide 328 is separated from the displacement member 324. Accordingly, the compressed air, which is discharged from the through-hole 340 of the displacement member 324, is discharged to the outside from a discharge port 342.

As described above, the discharge pressure of the compressed air discharged from the cylinder 12 can be retained to be a desired minimum preset pressure by increasing or decreasing the screwing amount of the adjustment screw 334 to adjust the resilient force of the first spring member 330.

The meter-in circuit 1 concerning the conventional technique shown in FIG. 19 is inconvenient in that the so-called delay of response time occurs, in which the time until the start of displacement of the piston is delayed when the operation of the cylinder is started again after the operation of the cylinder is stopped for a long period of time.

That is, the following inconvenience arises. When the cylinder is stopped for a long period of time (when the reciprocating movement of the piston is stopped for a long period of time), the flow rate is throttled on the supply side when the operation is started again. For this reason, a long period of time is required to obtain a predetermined pressure to drive the piston by charging the compressed air. The start of the piston is delayed corresponding thereto, and the delay of response time occurs.

On the contrary, the actuator control circuit 60 according to the third embodiment is provided at the supply passage 14 with the first speed control valve 16 which is constructed in the same manner as the meter-in circuit 1. The first speed control valve 16 is used to control the flow rate of the compressed air to be supplied to the first cylinder chamber 34*a*. On the other hand, the second relief-equipped pressure reducing valve 64*b* is provided between the discharge passage 18 and the pressure fluid supply source 22 for the compressed air to be discharged from the cylinder 12. The discharge pressure of the second cylinder chamber 34*b* is retained to be the previously set predetermined pressure by the aid of the compressed air charged from the second relief-equipped pressure reducing valve 64*b*.

Figure 18:
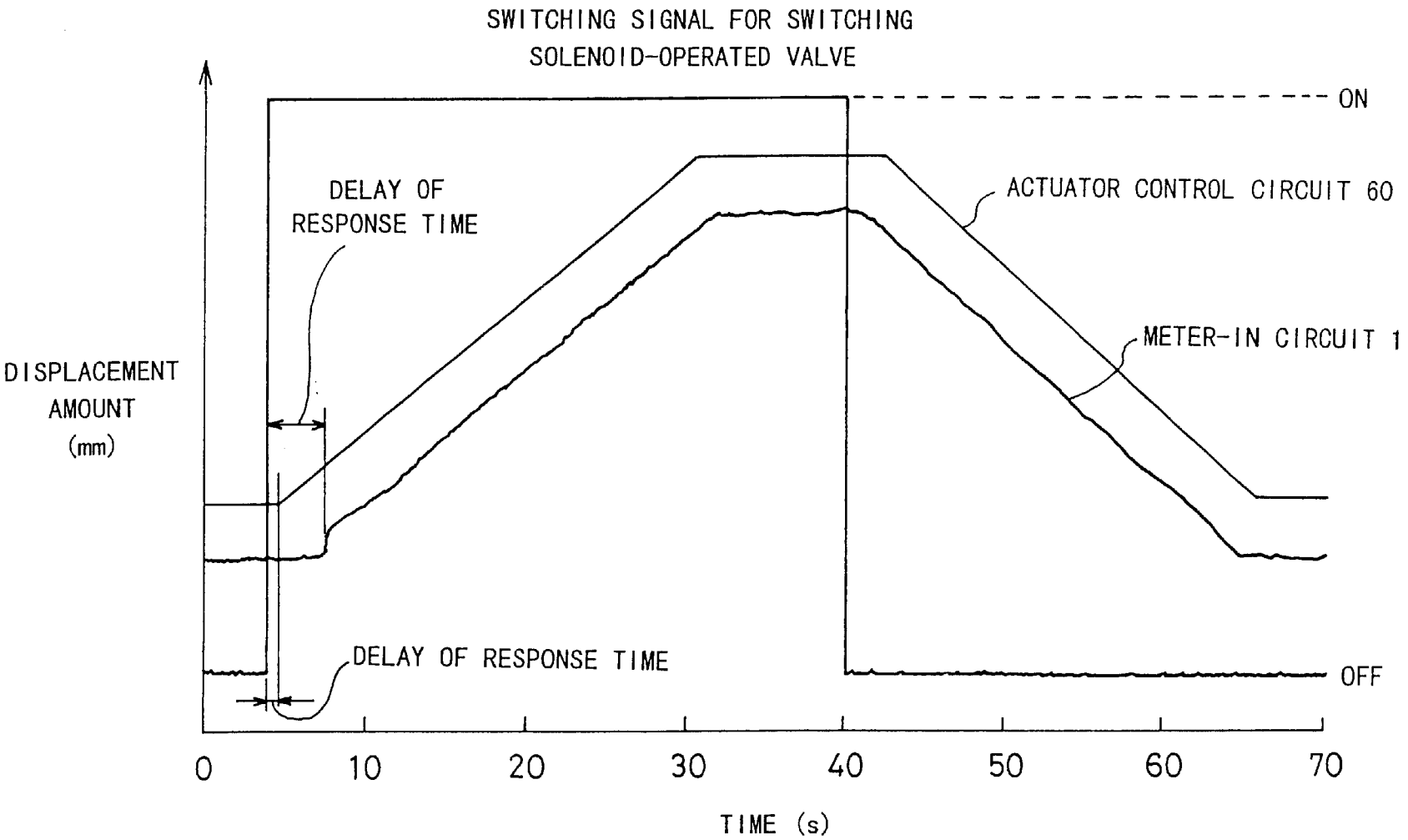
FIG. 18 shows characteristic curves illustrating the delay of response time of the meter-in circuits concerning the conventional technique and the actuator control circuit according to the third embodiment of the present invention respectively.

Therefore, when the operation of the cylinder 12 is stopped for a long period of time, the compressed air is charged via the second relief-equipped pressure reducing valve 64*b* (or the first relief-equipped pressure reducing valve 64*a*). Thus, the cylinder chamber 34*b* disposed on the discharge side (or the first cylinder chamber 34*a*) is retained to have the predetermined pressure. As a result, the pressure in the second cylinder chamber 34*b* (or the first cylinder chamber 34*a*), from which the compressed air is discharged, is previously retained to have a certain value. Accordingly, the time is shortened to charge the second cylinder chamber 34*b* (or the first cylinder chamber 34*a*) with the compressed air. Thus, an effect is obtained in that the delay of response time can be reduced as compared with the meter-in circuit 1 concerning the conventional technique (see FIG. 18).

What is claimed is:

1. An actuator control circuit based on the use of a meter-in circuit for controlling displacement speed of an actuator, said control circuit comprising:

a minimum pressure-retaining mechanism for making control such that a free flow state is given when a pressure fluid is supplied to said actuator, while pressure of said pressure fluid discharged from said actuator is retained to be a preset predetermined pressure, said minimum pressure-retaining mechanism including a first pressure control valve provided on a side of a first passage for said actuator and a second pressure control valve having identical constitutive components as said first pressure control valve and provided on a side of a second passage for said actuator, said first and second pressure control valve each including a valve body provided with a first port and a second port, a check valve for discharging said pressure fluid supplied from said first port from said second port in said free flow state and prohibiting flow of said pressure fluid from said second port to said first port, and a relief valve having a minimum pressure-retaining function for retaining said pressure of said pressure fluid discharged from said actuator to be at said preset predetermined pressure.

2. The actuator control circuit according to claim 1, wherein said relief valve includes a displacement member for being seated on a seat section in accordance with an action of resilient force of a spring member, and said displacement member is separated from said seat section when said pressure of said pressure fluid introduced into said valve body overcomes said resilient force of said spring member.

3. The actuator control circuit according to claim 1, wherein said actuator is composed of a pneumatic cylinder.

4. An actuator control circuit based on the use of a meter-in circuit for controlling displacement speed of an actuator, said control circuit comprising:

a pneumatic cylinder provided with a pair of ports for introducing and discharging compressed air and a piston for making displacement along cylinder chambers in accordance with an action of said compressed air supplied from said respective ports;

a switching mechanism for supplying said compressed air discharged from a compressed air supply source while making changeover between said first and second port of said pneumatic cylinder;

a first speed control valve and a second speed control valve provided between said pneumatic cylinder and said switching mechanism, for controlling flow rate of said compressed air to be supplied to said cylinder chamber; and a first pressure control valve and a second pressure control valve provided between said switching mechanism and said first speed control valve and said second speed control valve, for making control such that a free flow state is given when said compressed air is supplied to said pneumatic cylinder, while discharge pressure of said compressed air discharged from said cylinder chamber is retained to be a previously set predetermined pressure.

5. The actuator control circuit according to claim 4, wherein each of said first pressure control valve and said second pressure control valve includes a check valve and a relief valve which are arranged in series.

6. The actuator control circuit according to claim 5, wherein said relief valve includes a displacement member for being seated on a seat section in accordance with an action of resilient force of a spring member, and said displacement member is separated from said seat section when pressure of said compressed air introduced into a valve body overcomes said resilient force of said spring member.

7. The actuator control circuit according to claim 4, wherein each of said first pressure control valve and said second pressure control valve includes a check valve and a relief valve which are arranged in parallel.

8. The actuator control circuit according to claim 7, wherein said relief valve includes a displacement member for being seated on a seat section in accordance with an action of resilient force of a spring member, and said displacement member is separated from said seat section when pressure of said compressed air introduced into a valve body overcomes said resilient force of said spring member.

9. The actuator control circuit according to claim 4, which is provided with a control valve formed by integrally assembling said speed control valve and said pressure control valve.

10. The actuator control circuit according to claim 9, wherein said control valve includes:

a first check valve and a variable throttle valve arranged coaxially at the inside of a first valve body;

a second check valve and a relief valve arranged at the inside of a second valve body, said second valve body being provided rotatably about a center of rotation of an axis of said first valve body; and a third valve body provided rotatably about a center of rotation of a projection of said second valve body, wherein:

said first valve body, said second valve body, and said third valve body are formed by assembling them in an integrated manner respectively.

11. An actuator control circuit based on the use of a meter-in circuit for controlling displacement speed of an actuator, said control circuit comprising:

a pneumatic cylinder provided with a pair of ports for introducing and discharging compressed air and a piston for making displacement along cylinder chambers in accordance with an action of said compressed air supplied from said respective ports;

a switching mechanism for supplying said compressed air discharged from a compressed air supply source while making changeover between said first and second ports of said pneumatic cylinder; and a relief mechanism-equipped pressure control valve provided between said compressed air supply source and said switching mechanism, for retaining discharge pressure of said compressed air discharged from said cylinder chamber to be a previously set predetermined pressure.

12. The actuator control circuit according to claim 11, wherein said relief mechanism-equipped pressure control valve includes a pair of relief-equipped pressure reducing valves, and said relief-equipped pressure reducing valve retains pressure of said cylinder chamber disposed on a discharge side to be said previously set preset pressure by reducing pressure of said compressed air from said compressed air supply source to supply said compressed air to said cylinder chamber disposed on said discharge side.

13. The actuator control circuit according to claim 11, wherein a relief-equipped pressure reducing valve retains pressure of said cylinder chamber disposed on a discharge side to be said previously set predetermined pressure by discharging said compressed air to atmospheric air when pressure of said cylinder chamber disposed on said discharge side is higher than a preset pressure.

14. The actuator control circuit according to claim 11, wherein a pair of relief-equipped pressure reducing valves are arranged coaxially in a valve body, and a switching mechanism is formed and assembled integrally with said valve body for switching flow passages for supplying said compressed air.

* * * * *